US011769964B2

(12) United States Patent
Kugler et al.

(10) Patent No.: US 11,769,964 B2
(45) Date of Patent: Sep. 26, 2023

(54) ANGLED CONNECTOR AND METHOD OF ASSEMBLING AN ANGLED CONNECTOR

(71) Applicants: TE Connectivity Germany GmbH, Bensheim (DE); TE Connectivity India Private Limited, Bangalore (IN)

(72) Inventors: Marco Kugler, Bensheim (DE); Joachim Barth, Bensheim (DE); Danappa Hugar, Bangalore (IN); Vishnu Patagar, Bangalore (IN); Sukshitha H P, Bangalore (IN)

(73) Assignees: TE Connectivity India Private Limited, Bangalore (IN); TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 17/463,687

(22) Filed: Sep. 1, 2021

(65) Prior Publication Data

US 2022/0069518 A1 Mar. 3, 2022

(30) Foreign Application Priority Data

Sep. 3, 2020 (EP) ..... 20194283

(51) Int. Cl.
*H01R 13/627* (2006.01)
*H01R 13/52* (2006.01)
(Continued)

(52) U.S. Cl.
CPC ..... *H01R 13/6272* (2013.01); *H01R 13/5205* (2013.01); *H01R 13/6456* (2013.01); *H01R 13/6581* (2013.01)

(58) Field of Classification Search
CPC ..... H01R 13/4364; H01R 13/4365; H01R 13/6272; H01R 13/5205; H01R 13/6456; H01R 13/6581
(Continued)

(56) References Cited

U.S. PATENT DOCUMENTS 4,900,271 A * 2/1990 Colleran ..... H01R 13/113 439/856
5,425,656 A * 6/1995 Wakata ..... H01R 13/4365 439/744
(Continued)

FOREIGN PATENT DOCUMENTS

DE 102013201125 A1 7/2014

OTHER PUBLICATIONS

Extended European Search Report, European Application No. 20194283.6-1201, European Date, dated Jan. 25, 2021.

*Primary Examiner* — Gary F Paumen
(74) *Attorney, Agent, or Firm* — Barley Snyder

(57) ABSTRACT

An angled connector includes a connector housing, a terminal support held by the connector housing, and a first terminal held in the terminal support. The connector housing has a first terminal passage and a second terminal passage extending at an angle to the first terminal passage. The first terminal passage and the second terminal passage intersect one another in an intersection region. The terminal support is slidable relative to the connector housing along the first terminal passage from a first position to a second position. The first terminal at least partially extends into the first terminal passage. The first terminal is closer to the second terminal passage in the second position than in the first position, and the first terminal is at least partially arranged in the intersection region in the second position.

19 Claims, 6 Drawing Sheets

(51) Int. Cl.
*H01R 13/645* (2006.01)
*H01R 13/6581* (2011.01)

(58) Field of Classification Search
USPC ..... 439/752, 752.5
See application file for complete search history.

(56) References Cited

U.S. PATENT DOCUMENTS

| | | | | |
|---|---|---|---|---|
| 5,782,657 | A * | 7/1998 | Wolla | H01R 13/5221 439/595 |
| 5,989,066 | A * | 11/1999 | Cox | H01R 13/4365 439/752 |
| 8,388,388 | B2 * | 3/2013 | Suzuki | H01R 13/113 439/752.5 |
| 10,811,804 | B1 * | 10/2020 | Probert | H01R 13/424 |
| 2002/0016106 | A1 * | 2/2002 | Okayasu | H01R 43/26 439/595 |
| 2018/0034172 | A1 | 2/2018 | Singhammer et al. | |

* cited by examiner

ANGLED CONNECTOR AND METHOD OF ASSEMBLING AN ANGLED CONNECTOR

CROSS-REFERENCE TO RELATED APPLICATIONS

This application claims the benefit of the filing date under 35 U.S.C. § 119(a)-(d) of European Patent Application No. 20194283, filed on Sep. 3, 2020.

FIELD OF THE INVENTION

The present invention relates to a connector and, more particularly, to an angled connector.

BACKGROUND

Angled connectors are commonly used for detachable connections of electrical components for allowing, in the coupled state, the transmission of current and/or electrical signals. Since angled connectors allow a change of the plugging direction, they are particularly preferred in applications with tight space constraints.

However, the installation of the angled connectors has proven to be cumbersome. For example, the angled connector may comprise two housing shells, each carrying a respective terminal, wherein the two housing shells may be mounted to one another. The connection of the two housing shells needs to be sealed with a watertight sealing, which is complicated and prone to errors. Moreover, additional costs are incurred for the manufacture, transport and assembly of a multipart housing. Furthermore, a customer or operator is usually required to install the second terminal, for example a cable end terminal, on site. The first terminal, however, may be different to the second terminal; it may be an interface terminal. The customer or operator usually does not possess the necessary equipment for processing and installing the interface terminal, such as stamping equipment.

SUMMARY

An angled connector includes a connector housing, a terminal support held by the connector housing, and a first terminal held in the terminal support. The connector housing has a first terminal passage and a second terminal passage extending at an angle to the first terminal passage. The first terminal passage and the second terminal passage intersect one another in an intersection region. The terminal support is slidable relative to the connector housing along the first terminal passage from a first position to a second position. The first terminal at least partially extends into the first terminal passage. The first terminal is closer to the second terminal passage in the second position than in the first position, and the first terminal is at least partially arranged in the intersection region in the second position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
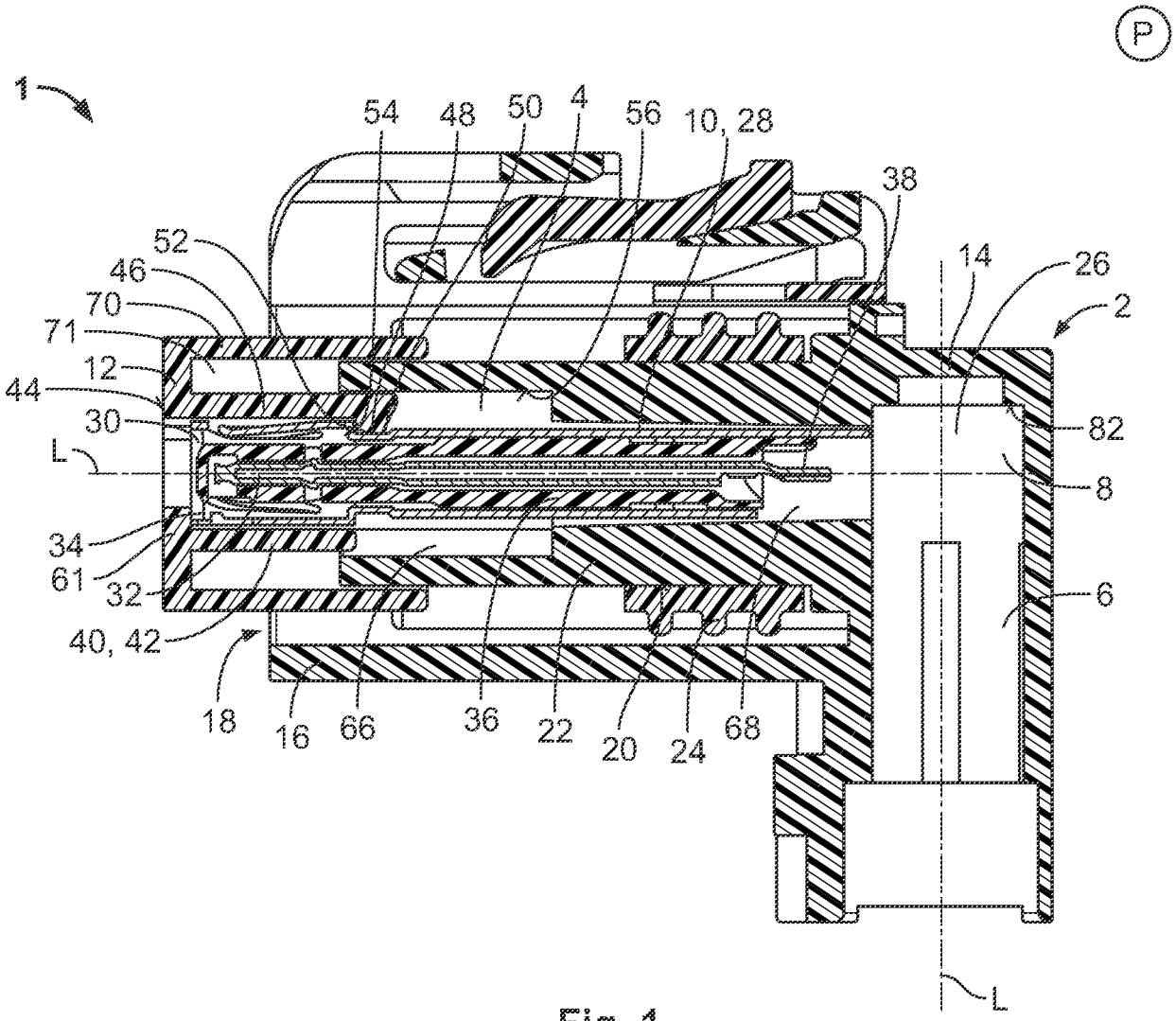
FIG. 1 is a sectional side view of an angled connector according to an embodiment.

In the following, the exemplary embodiments of the angled connector, according to the invention, are explained in greater detail with reference to the accompanying drawings.

In the figures, the same reference numerals are used for elements which correspond to one another in terms of their function and/or structure.

According to the description of the various aspects and embodiments, elements shown in the drawings can be omitted if the technical effects of these elements are not required for a particular application, and vice versa: i.e. elements that are not shown in the figures but are described herein can be added if the technical effect of those particular elements is advantageous in a specific application.

An angled connector 1 according to an embodiment is shown in FIG. 1. The angled connector 1 comprises a connector housing 2 having a first terminal passage 4 and a second terminal passage 6 extending at an angle, in this case essentially perpendicular to the first terminal passage 4, the first terminal passage 4 and the second terminal passage 6 intersecting one another in an intersection region 8. The first terminal passage 4 may have a hollow, tube-like shape.

The first terminal passage 4 may extend along a longitudinal axis L being arranged at an angle, particularly essentially perpendicular, to the longitudinal axis L of the second terminal passage 6, whereby the longitudinal axes L of the respective passages may intersect one another in the intersection region 8. In an embodiment, the angled connector 1 may be an elbow connector, such as a 90° angled connector, wherein a longitudinal axis L of the first terminal passage 4 may be arranged at about 90° angle to the longitudinal axis L of the second terminal passage 6. However, other embodiments, such as 30° or 45° angled connectors, may also be provided.

Figure 5:
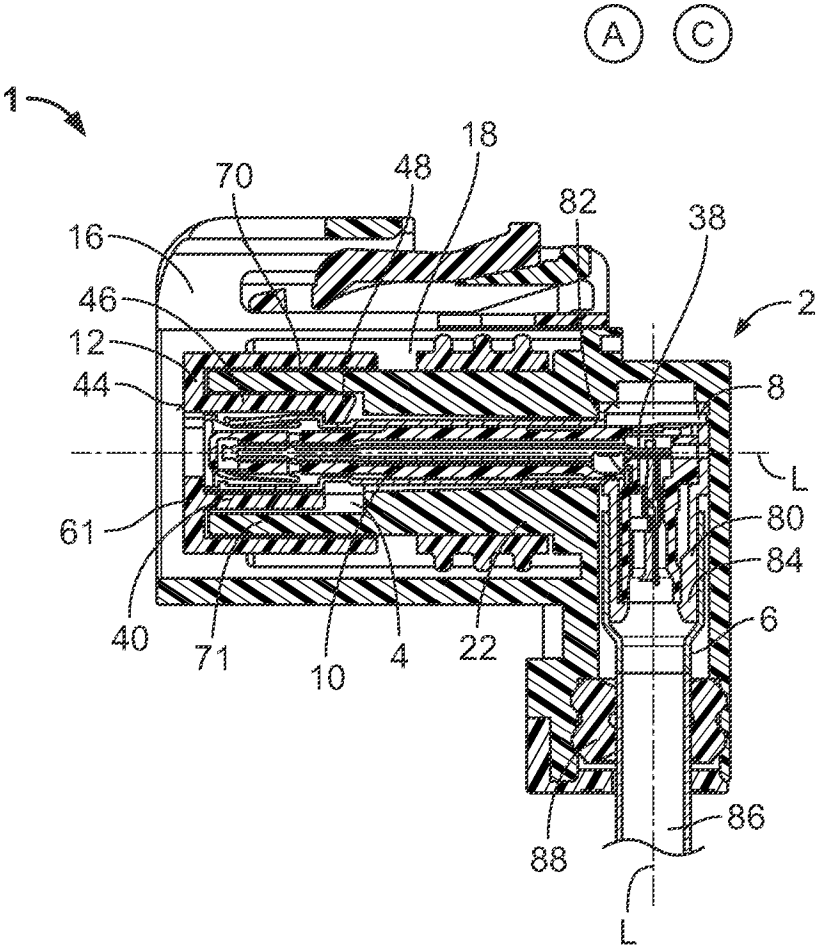
FIG. 5 is a sectional side view of the angled connector assembled.

The angled connector 1 further comprises a first terminal 10, the first terminal 10 being held in a terminal support 12 and at least partially extending into the first terminal passage 4, as shown in FIG. 1. The terminal support 12 is held slidable relative to the connector housing 2 along the first terminal passage 4, essentially parallel to the longitudinal axis L of the first terminal passage 4, from a first, pre-mount, position P, as shown in FIG. 1, to a second, connection position C, as shown in FIG. 5. In the second position C, the first terminal 10 is arranged closer to the second terminal passage 6 than in the first position P, whereby in the second position C, the first terminal 10 is at least partially arranged in the intersection region 8.

In an embodiment, the connector housing 2, particularly the parts comprising the respective sections, may be formed as a monolithic component 14 or a unitary housing. Therefore, the passages 4, 6 may form a continuous through channel of the housing 2 and no cumbersome sealing of two composite housing parts, each forming a part of a passage, is necessary.

The connector housing 2, as shown in FIG. 1, may have a housing sleeve 16 surrounding the first terminal passage 4, the housing sleeve 16 being radially spaced apart from the first terminal passage 4. Thus, a sealing compartment 18 may be formed between an outer surface 20 of a wall 22 of the first terminal passage 4. The wall 22 may particularly be tube shaped and surround at least partially the first terminal passage 4. A sealing ring 24 may be positioned in the sealing compartment 18, fitting around the outer surface 20 of the wall 22 allowing for a sealed connection between the angled connector 1 and a complementary connector, which compresses the sealing wing 24 between an inner surface and the outer surface 20 of the wall 22.

As shown in FIG. 1, the intersection region 8 may form respective distal end sections 26 of the respective passages 4, 6. Thus, the first terminal passage 4 and the second terminal passage 6 together, form an essentially elbow shaped through channel.

The first terminal 10 may particularly be an interface terminal 28, as shown in FIG. 1, for mating with a complementary terminal of the complementary connector. Thus, the angled connector 1 may be adapted as a plug connector. The interface terminal 28 may comprise an interface end 30 facing away from the second terminal passage 6 and/or the intersection region 8. A conductor 32 of the first terminal 4 may at least partially be surrounded by an electromagnetic shielding 34. An electric insulation 36 may be provided between the conductor 32 and the shielding 34. The conductor 32 may be a central conductor and the shielding 34 may be arranged coaxially to the central conductor 32. At a connection end 38 of the first terminal 10 opposite the interface end 30 facing towards the second terminal passage 6 and/or the intersection region 8, the conductor 32 may be at least partially bare for connecting to a second terminal. Therefore, the shielding 34 and/or an insulation does not interfere in connecting the first terminal 10 to the second terminal 80.

In an embodiment, the interface end 30 of the first terminal 10 may be held by the terminal support 12. The terminal support 12 may particularly extend over less than half of the first terminal 10, the half being opposite the second terminal passage 6, in order to keep a weight of the angled connector 1 to a minimum and safe material costs. In other words, the terminal support 12 may extend over less than half of the first terminal 10 starting from the interface end 30.

The terminal support 12 may be adapted to hold only a tip of the first terminal 10, e.g. the interface end 30 of the first terminal 10, and at least partly be arranged outside of the first terminal passage 4 at least in one of the first and second position P, C, particularly in both positions. Thus, the terminal support 12 may be easily accessed, allowing a convenient actuation of the terminal support 12 for inducing movement between the first and second position.

The terminal support 12 of the first embodiment is further explained in detail with reference to FIGS. 1, 2 and 3. The terminal support 12 may be formed of an electrical insulating material, such as an electrical insulating resin, for example by an injection molding process. Hence, the operator may safely handle the terminal support 12 without risking an electric shock. The first terminal 10 and the terminal support 12 may be separate parts which are detachable from one another, so that the first terminal 10 and the terminal support 12 may be formed in different production steps and replaced independently from one another if one part fails or is damaged.

Figure 2:
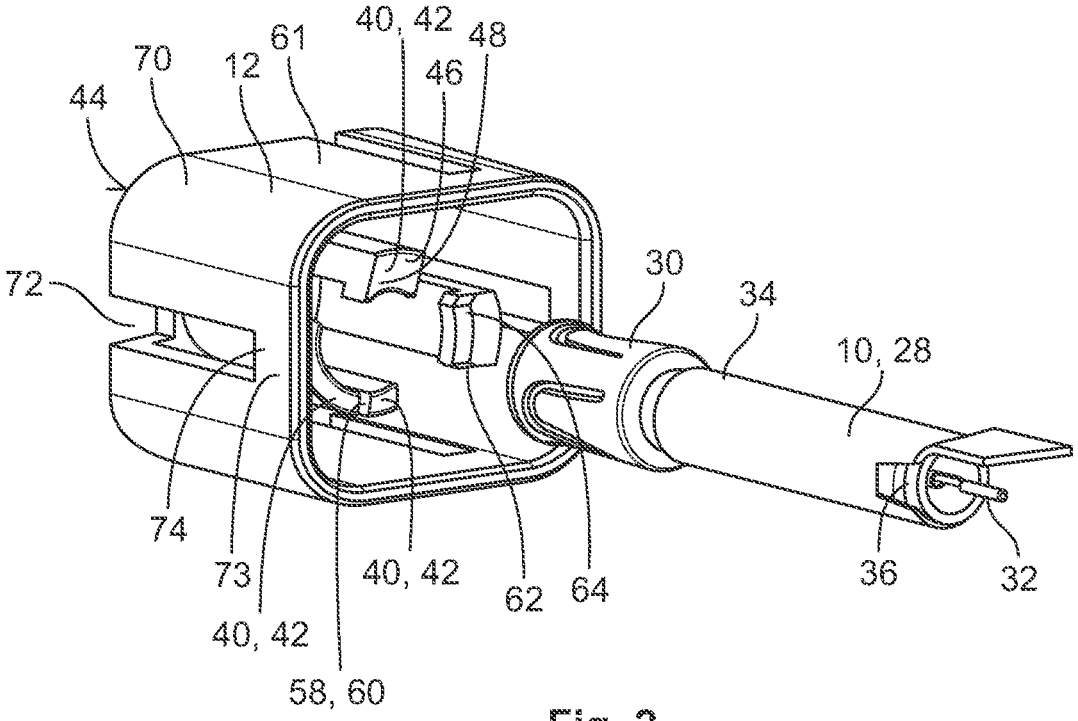
FIG. 2 is a perspective view of a terminal support and a first terminal of the angled connector.
Figure 3:
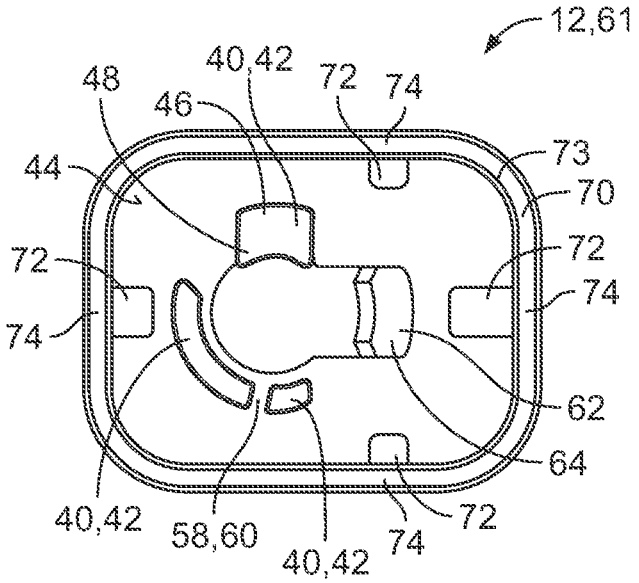
FIG. 3 is a top view of the terminal support.

The interface end 30 of the first terminal 10 may be at least partially supported by a support collar 40, shown in FIGS. 1-3, stabilizing the first terminal 10 within the terminal support 12, and preventing accidental falling off the first terminal 10 due to stress, such as vibrational stress. The support collar 40 may at least partially fit tightly on a radial outer surface of the first terminal 10 and extend into the first terminal passage 4. Various columns 42 may form the support collar 40, the columns 42 extending from a front face 44 of the terminal support 12 essentially parallel to the longitudinal axis L of the first terminal passage 4 towards the second terminal passage 6, the front face 44 being arranged at a distal end of the terminal support 12, distal to the second terminal passage 6.

The columns 42 may be spaced apart from one another in a circumferential direction, as shown in FIGS. 2 and 3. In this exemplary embodiment, one column 42 is formed as a securing latch 46 for securing the relative position of the first terminal 10 and the terminal support 12 in at least one direction essentially parallel to the longitudinal axis L of the first terminal passage 4. In an embodiment, the securing latch 46 forms a form lock with the first terminal 10, such that pulling the first terminal 10 relative to the terminal support 12 towards the second terminal passage 6 may be prevented. For this, the securing latch 46 may comprise a radially inward protruding shoulder 48 at its free end distal to the front face 44. The shoulder 48 may engage a recess 50 of the first terminal 10, as shown in FIG. 1, such that an engagement surface 52 of the shoulder 48 facing away from the second terminal passage 6 abuts a counter engagement surface 54 of the first terminal 10 facing towards the second terminal passage 6. The securing latch 46 creates a form lock between the first terminal 10 and the securing latch 46, preventing relative movement of the first terminal 10 and the terminal support 12 in at least one direction essentially parallel to the longitudinal axis L of the first terminal 10.

The securing latch 46 may be elastically deflectable and may, in an embodiment, be more flexible than the remainder of the support collar 40. For this, the length of the securing latch 46 in a direction essentially parallel to the longitudinal axis L of the first terminal passage 4 may be larger than the remainder of the support collar 40. Particularly, the free end comprising of or consisting of the radially inward protruding shoulder 48 may extend beyond the remainder of the support collar 40 towards the second terminal passage 6. This may lead to an extension of the lever arm of the securing latch 46, increasing the flexibility of the securing latch 46. To further increase the flexibility of the securing latch 46, the securing latch 46 may extend in the circumferential direction along less than a 40° arc, and in an embodiment less than a 30° arc. Hence, the first terminal 10 may be easily mounted to the support collar 40 by deflecting the securing latch 46 radially outwardly. The remainder of the support collar 40 may be rather rigid compared to the at least one securing latch 46.

When the terminal support 12 is mounted to the connector housing 2, the securing latch 46 may advantageously be supported by an inner surface 56 of the first terminal passage's 4 wall 22. Therefore, a deflection of the securing latch 46 radially outwards for disengaging the first terminal 10 may be prevented, further securing the first terminal 10 within the terminal support 12.

In order to secure the relative rotational position of the first terminal 10 and the terminal support 12 and/or ensure coupling of the first terminal 10 in a predetermined relative rotational position, the first terminal 10 and the terminal support 12 may comprise complementary formed keying features 58, of which only the keying feature 58 of the terminal support 12 is shown in FIGS. 2 and 3. The keying feature 58 of the terminal support 12 may be formed as a slot 60 extending essentially parallel to the longitudinal axis L of the first terminal passage 4, the slot 60 being open towards the second terminal passage 6 and separating two parts of the support collar 40. In an embodiment, the slot 60 may be arranged opposite the securing latch 46 and may separate two parts from the remainder of the support collar 40 in the circumferential direction.

The slot 60 may be arranged opposite the at least one securing latch 46 separating two parts from the remainder of the support collar 40 in the circumferential direction. Therefore, the two parts of the support collar 40 being arranged adjoining to the slot 60, or at least one of the two, may be formed rather rigidly, for example by extending over a larger arc in the circumferential direction and/or a lower length essentially parallel to the longitudinal axis L of the first terminal 10. The rigidity of the support collar 40 adjoining the slot 60 may further secure the rotational lock provided by the complementary formed keying feature 58.

A rail may be provided as the complementary keying feature 58 formed on the first terminal 10. The rail may protrude radially outwards from the first terminal 10, particularly the interface end 30 of the first terminal 10 shown in FIG. 2, and may be adapted to be fittingly received in the slot 60, so that relative rotational position of the first terminal 10 and the terminal support 12 is secured in a form fitting manner.

To ensure that the first terminal 10, particularly the connection end 38, does not interfere with the second terminal when the terminal support 12 is secured in the first position P shown in FIG. 1, the first terminal 10, the connection end 38 may be arranged outside the intersection region 8. Therefore, the operator may insert the second terminal 80 into the second terminal passage 6 without risking damaging one of the terminals; particularly, shearing of the conductor 32 upon insertion of the second terminal 80 can be averted. The connection end 38 can be arranged in the intersection region 8 in the second position C.

A mode of securing the terminal support 12 in at least one of the first position P and the second position C is to secure the terminal support 12 against movement in at least one direction essentially parallel to the longitudinal axis L of the first terminal passage 4 by a form lock. In this case, the terminal support 12 may be a terminal position assurance 61. For this, the terminal support 12 may comprise a locking latch 62, which can be seen in FIGS. 2 and 3 as well as FIGS. 7 and 8. The locking latch 62 may be elastically deflectable and extend from the front face 44 into the first terminal passage 4, essentially parallel to the longitudinal axis L. In an embodiment, the locking latch 62 may comprise a larger length essentially parallel to the longitudinal axis L of the first terminal passage 4 than the support collar 40, particularly the securing latch 46.

The locking latch 62 may be adapted to lock the terminal support 12, at least in the first position P, and in an embodiment in both positions P, C. Therefore, the operator does not have to worry about accidental movement of the terminal support 12 during insertion of the second terminal 80 into the second terminal passage 6. The operator does not have to hold the terminal support 12 or the first terminal 10 and thus has both hands to his/her disposal for the insertion of the second terminal 80.

In an embodiment, the at least one locking latch 62 and the connector housing 2 may form a form lock in at least one of the first and second position P, C. With the form lock, wear on the connector housing 2 as well as the terminal support 12 may be reduced and lower forces may be necessary to push the terminal support 12 from the first position P to the second position C or vice versa. Only an initial force for deflecting the at least one locking latch 62 out of engagement of the form lock is necessary for inducing a relative movement of the terminal support 12 essentially parallel to the longitudinal axis L relative to the first terminal passage 4.

A snap nose 64 may be formed on a free end of the locking latch 62, protruding radially inwards and being adapted to engage a notch 63 formed on an outer surface of a wall 65 of the first terminal passage 4. The wall 65 may be adapted to extend into a gap formed between the locking latch 62 on one side and the support collar 40 and/or first terminal 10 on the other side, so that the locking latch 62 may slide along the outer surface of the wall 65, shown in FIG. 7. Therefore, movement parallel to the longitudinal axis L may be prevented due to the latching engagement of the snap nose 64 and the notch 63.

In order to provide sufficient space for the locking latch 62 to be elastically deflected to disengage the notch, a play 67 may be provided radially outwards from the locking latch 62 in the radial direction. The locking latch 62 may extend in the circumferential direction along an arc section, the arc section being arranged circumferentially shifted to the support collar 40.

Additionally or alternatively, the arc section, along which the locking latch 62 extends, may be radially offset from the support collar 40. Therefore, the support collar 40 does not disrupt the freedom of a deflection movement of the locking latch 62.

As can be seen in FIG. 1 for example, the first terminal passage 4 may comprise a radially widened entry 66 distal to the second terminal passage 6 essentially parallel to the longitudinal axis L of the first terminal passage 4. The entry 66 may be adapted to fittingly receive the support collar 40 such that the support collar 40 may not be deflected radially outwards. Additionally, the entry 66 may be adapted to receive the locking latch 62.

For stabilizing the first terminal 10 within the first terminal passage 4, the first terminal passage 4 may comprise a radial constriction 68, shown in FIG. 1, in which the first terminal 10 is fittingly held. The radial constriction 68 may extend from the entry 66 to the distal end section 26 of the first terminal passage 4 that is arranged in the intersection region 8.

In an embodiment, the terminal support 12 may further comprise a guiding collar 70 shown in FIG. 1 for guiding the movement between the terminal support 12 and a mating connector, particularly the movement of the terminal support 12 essentially parallel to the longitudinal axis L along the first terminal passage 4. The guiding collar 70 may surround the support collar 40 and the locking latch 62 forming a radial outer wall of the terminal support 12. In an embodiment, the guiding collar 70 may extend from the front face 44 in direction essentially parallel to the longitudinal axis L of the first terminal passage 4 towards the second terminal passage 6.

A gap 71 may be formed between the guiding collar 70 and the support collar 40 and/or the locking latch 62, whereby the wall 22 of the first terminal passage 4 may be received in said gap 71 essentially parallel to the longitudinal axis L of the first terminal passage 4.

In an embodiment, the front face 44 is closed between the support collar 40 and the guiding collar 70 so that the wall 22 may abut against the inner surface of the front face 44 when pushing the terminal support 12 too deep into the first terminal passage 4, as shown in FIG. 5. When at least one locking latch 62 is adapted to deflect radially outwards, the at least one locking latch 62 may be surrounded by the guiding collar 70 and may be radially distanced to the guiding collar 70, so that space is provided for the locking latch 62 to deflect radially outwards.

The guiding collar 70 may rest on the outer surface 20 of the wall 22, whereby the guiding collar 70 may circumferentially surround the wall 22 at least partially. Therefore, a tilting of the terminal support 12 relative to the connector housing, particularly the first terminal passage 4, may be averted.

The guiding collar 70 may comprise at least one guiding slot 72, shown in FIG. 2, extending from the front face 44 essentially parallel to the longitudinal axis L of the first terminal passage 4 towards the second terminal passage 6. In this exemplary embodiment, the guiding collar 70 extends circumferentially along an essentially rectangular shape having two opposing narrow sides and two opposing wide sides connecting the narrow sides to one another. Each side may comprise a guiding slot 72, wherein the guiding slots 72 arranged at the narrow sides may be arranged at the center of said sides opposing each other. The guiding slots 72 arranged at the wide sides may be arranged opposite each other off-center of the wide sides. In an embodiment, the guiding slots 72 may be arranged off center at one side. If the guiding collar 70 comprises an essentially rectangular configuration, the two opposing narrow sides may have the guiding slots 72 arranged centrally on said narrow sides and the guiding slots 72 arranged on the wider sides may be arranged off center.

The guiding slots 72 may further act as a polarization feature signaling the correct rotational position for mounting the terminal support 12 to the connector housing 2 and/or for mating the mating connector with the angled connector 1. In order to prevent the mating connector for being pushed too far into the first terminal passage 4 beyond the terminal support 12, the at least one guiding slot 72 may be closed at a distal end 73 directed towards the second terminal passage 6, e.g. by a bridge 74 as shown in FIG. 2. Complementary to the guiding slots 72, guiding ribs may be provided on the mating connector, which may be adapted to be received in the corresponding guiding slots 72. The radially protruding rib abuts the bridge 74 when mating the mating connector with the angled connector 1 essentially parallel to the longitudinal axis L out of the first terminal passage 4.

The angled connector 1 may be pre-assembled in the first position P, as shown in FIG. 1, at a manufacturing site. In the first position P, the first terminal 10, particularly the connection end 38 of the first terminal 10, does not intersect an insertion path of the second terminal for insertion into the second terminal passage 6. The terminal support 12 may be secured in the first position P essentially parallel to the longitudinal axis L in a form locking manner preventing movement of the terminal support 12 further into the first terminal passage 4 towards the second terminal passage 6. Therefore, the operator may further concentrate solely on the insertion of the second terminal 80 before directing the attention to completing the connection by pushing the terminal support 12 into the second position C.

Figure 4:
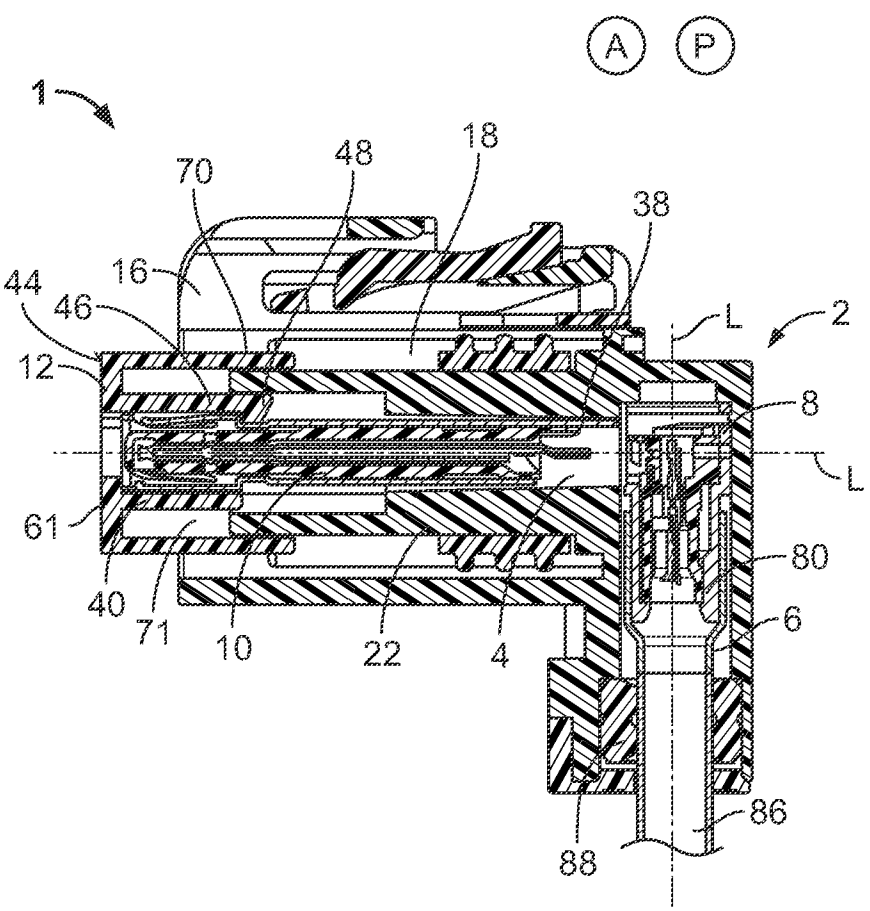
FIG. 4 is a sectional side view of the angled connector with a second terminal inserted into a second terminal passage.

As is shown in FIGS. 4 and 5, the second terminal 80 may be inserted into the second terminal passage 6 until abutment against an abutment surface 82 formed at the distal end section 26 essentially perpendicular to the longitudinal axis L of the second terminal passage 6. The abutment surface 82 may be formed on the inner surface 56 of the first terminal passage 4's wall 22 at the intersection region 8, as shown in FIG. 1.

The second terminal 80 may be a cable end terminal 84 being assembled onto an end of an electric cable 86, for example by crimping or the like, as shown in FIGS. 4 and 5. A seal 88, circumferentially surrounding the electric cable 86, may be provided to seal the entry of the second terminal passage 6 distal to the first terminal passage 4 and the intersection region 8. The seal 88 may be compressed between an outer surface of the cable 86 and an inner surface of a wall of the second terminal passage 6.

According to the inventive method, the terminal support 12 is secured in the first position P shown in FIG. 4 before insertion of the second terminal 80 into the second terminal passage 6, shown in FIG. 5. The second terminal 80 may be inserted until abutment against the abutment surface 82, signaling the operator that the second terminal 80 is positioned in an assembly position A. In the method, the terminal support 12 is secured in the first position P before the second terminal 80 is inserted into the second terminal passage 6 into the assembly position A. The abutment of the second terminal 80 with the abutment surface 82 indicates to an operator that the terminal support 12 may be safely pushed into the second position C from the first position P to connect the terminals 10, 80 with one another.

Figure 6:
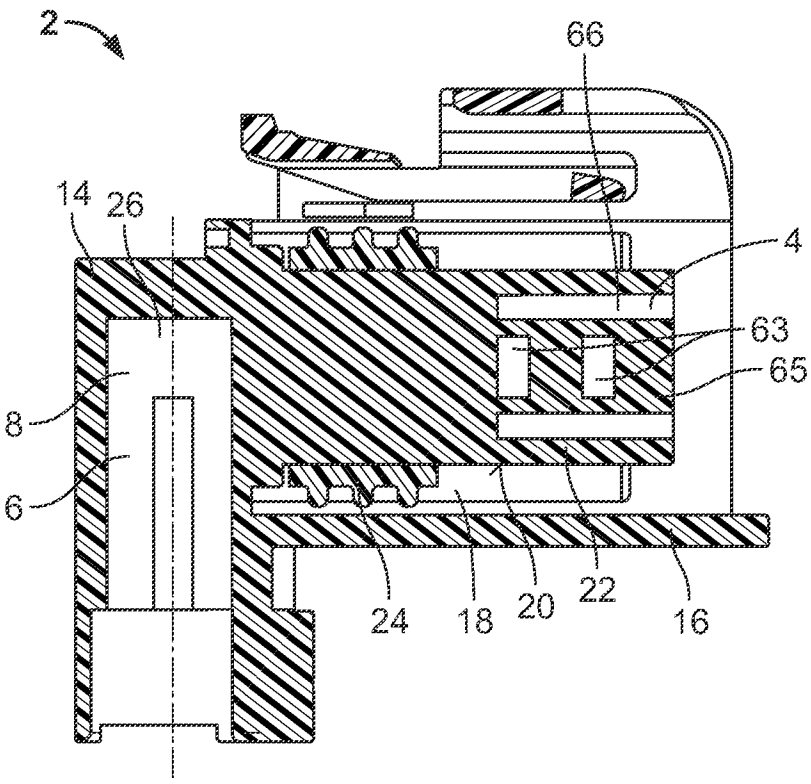
FIG. 6 is a sectional side view of a connector housing of the angled connector.
Figure 7:
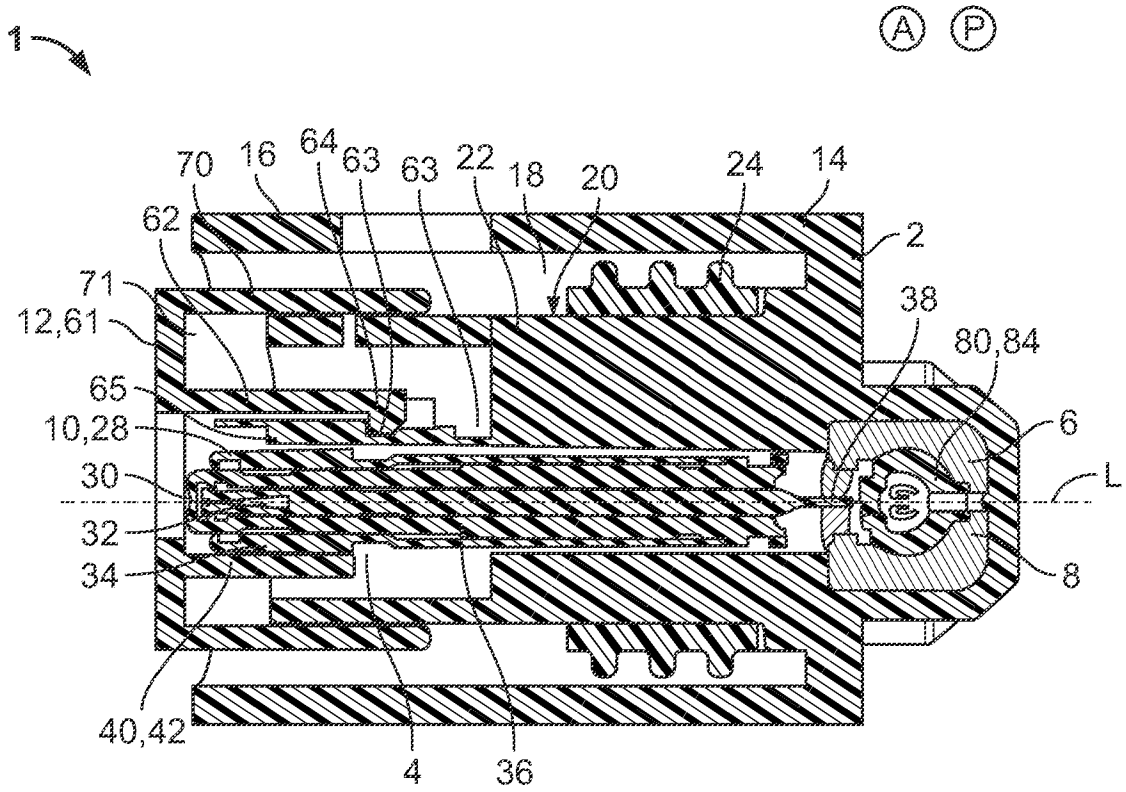
FIG. 7 is a sectional side view of the angled connector with a terminal support secured in a first position.

Consequently, the operator may push the terminal support 12 from the first position P into the second position C pushing the connection end 38 into engagement with the second terminal 80, as is shown in FIG. 5. As can be seen in FIG. 6, the wall 65 may comprise two notches 63 formed on the outer surface of the wall 65. The two notches 63 may be spaced apart from one another along the longitudinal axis of the first terminal passage 4, so that a first notch 63 being distal to the second terminal passage 6 may engage the snap nose 64 in a form locking manner in the first position P, as shown in FIG. 7. By exerting a pushing force to the terminal support 12, the locking latch 62 may be deflected radially outwards so that the form lock is released and the terminal support 12 may be pushed further into the first terminal passage 4 towards the intersection region 8.

Figure 8:
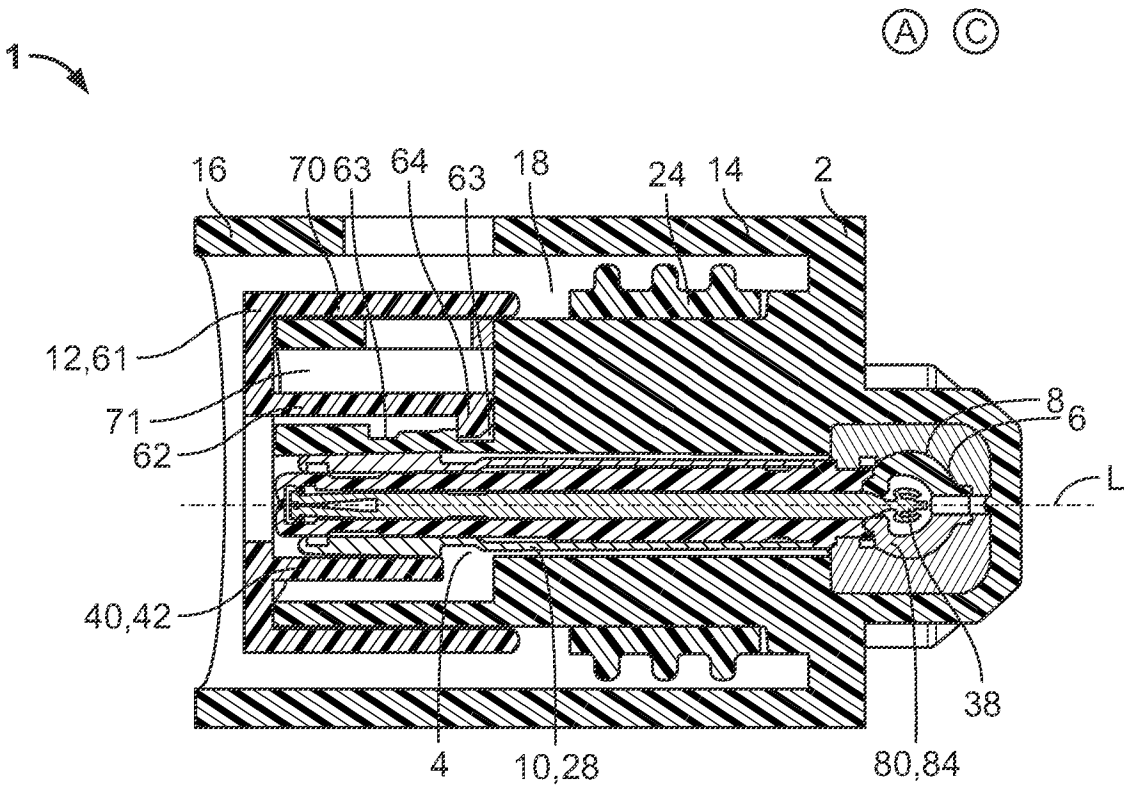
FIG. 8 is a sectional side view of the angled connector with the terminal support secured in a second position.

In an embodiment, the terminal support 12 may be secured in the second position C essentially parallel to the longitudinal axis L of the first terminal passage 4 in a form locking manner by having the snap nose 64 engage a second notch 63 proximal to the second terminal passage 6, as shown in FIG. 8. The form lock may at least prevent movement of the terminal support 12 out of the first terminal passage 4 away from the second terminal passage 6 essentially parallel to the longitudinal axis L of the first terminal passage 4. Hence, the connection between the first terminal 10 and the second terminal 80 may be further secured by the terminal support 12 preventing accidental disengagement due to high stress, such as vibrational stress.

With the inventive solution, the first terminal 10 may be pre-mounted at the manufacturing site, while the second terminal 80 may be mounted on site by the operator. Therefore, the operator does not need additional equipment for processing the first terminal 10. The first terminal 10 may be mounted and secured in the first position P at the manufacturing site, wherein in the first position P, the first terminal 10 does not interfere with the second terminal 80. Thus, the operator may easily insert the second terminal 80 into the second passage 6 in the assembly position A without risking damage to any of the terminals 10, 80. Once the second terminal 80 is in the assembly position, the operator may push the terminal support 12 into the second position C, so that the first and second terminals 10, 80 may be connected to one another in a form- and/or force-locking manner.

What is claimed is:

1. An angled connector, comprising:

a connector housing having a first terminal passage and a second terminal passage extending at an angle to the first terminal passage, the first terminal passage and the second terminal passage intersect one another in an intersection region;

a terminal support held by the connector housing and slidable relative to the connector housing along the first terminal passage from a first position to a second position; and a first terminal removably held in the terminal support by one or more latches, and at least partially extending into the first terminal passage, the first terminal is closer to the second terminal passage in the second position than in the first position, and the first terminal is at least partially arranged in the intersection region in the second position.

2. The angled connector of claim 1, wherein the terminal support has a support collar at least partially surrounding the first terminal.

3. The angled connector of claim 2, wherein the one or more latches includes a securing latch, and the support collar has the securing latch engaging the first terminal and securing the first terminal to the terminal support.

4. The angled connector of claim 1, wherein the terminal support and the first terminal have a plurality of complementary formed keying features dictating a relative rotational position of the first terminal and the terminal support.

5. The angled connector of claim 4, wherein one of the complementary formed keying features of the terminal support is on a support collar of the terminal support at least partially surrounding the first terminal.

6. The angled connector of claim 1, wherein the one or more latches includes a locking latch, and the terminal support has the locking latch locking the terminal support in at least one of the first position and the second position.

7. The angled connector of claim 6, wherein the locking latch is spaced apart from the first terminal.

8. The angled connector of claim 7, wherein the locking latch engages the connector housing in at least one of the first position and the second position in a form lock.

9. The angled connector of claim 2, wherein the terminal support has a guiding collar guiding movement of the terminal support relative to the connector housing along the first terminal passage.

10. The angled connector of claim 9, wherein the guiding collar surrounds the support collar.

11. The angled connector of claim 10, wherein a gap is formed between the guiding collar and the support collar in which a wall of the first terminal passage is at least partly received.

12. The angled connector of claim 9, wherein the guiding collar has a guiding slot extending essentially parallel to the first terminal passage from a front face of the terminal support facing away from the intersection region.

13. The angled connector of claim 12, wherein the guiding slot is closed at a distal end opposite the front face.

14. The angled connector of claim 1, wherein the terminal support extends over less than half of the first terminal on a half of the first terminal opposite the second terminal passage.

15. The angled connector of claim 1, wherein the terminal support is electrically insulating.

16. A method of assembling an angled connector, comprising:

providing a connector housing having a first terminal passage and a second terminal passage extending at an angle to the first terminal passage, the first terminal passage and the second terminal passage intersect one another in an intersection region;

providing a terminal support held by the connector housing and slidable relative to the connector housing along the first terminal passage from a first position to a second position;

providing a first terminal held in the terminal support and at least partially extending into the first terminal passage, the first terminal is closer to the second terminal passage in the second position than in the first position, and the first terminal is at least partially arranged in the intersection region in the second position;

removably securing the terminal support in the first position by engaging a latch; and introducing a second terminal into the second terminal passage after removably securing the terminal support in the first position, the second terminal for connecting to the first terminal in the intersection region.

17. The method of claim 16, further comprising pushing the terminal support into the second position after the second terminal is introduced into the second terminal passage into an assembly position, whereby the terminal support extends over less than half of the first terminal on a half of the first terminal opposite the second terminal passage.

18. An angled connector, comprising:

a connector housing having a first terminal passage and a second terminal passage extending at an angle to the first terminal passage, the first terminal passage and the second terminal passage intersect one another in an intersection region;

a terminal support having a support collar at least partially surrounding the first terminal and a guiding collar guiding movement of the terminal support relative to the connector housing along the first terminal passage, wherein the guiding collar surrounds the support collar and a gap is formed between the guiding collar and the support collar in which a wall of the first terminal passage is at least partly received, the terminal support held by the connector housing and slidable relative to the connector housing along the first terminal passage from a first position to a second position; and a first terminal held in the terminal support and at least partially extending into the first terminal passage, the first terminal is closer to the second terminal passage in the second position than in the first position, and the first terminal is at least partially arranged in the intersection region in the second position.

19. An angled connector, comprising:

a connector housing having a first terminal passage and a second terminal passage extending at an angle to the first terminal passage, the first terminal passage and the second terminal passage intersect one another in an intersection region;

a terminal support held by the connector housing and slidable relative to the connector housing along the first terminal passage from a first position to a second position, wherein the terminal support extends over less than half of the first terminal on a half of the first terminal opposite the second terminal passage; and a first terminal held in the terminal support and at least partially extending into the first terminal passage, the first terminal is closer to the second terminal passage in the second position than in the first position, and the first terminal is at least partially arranged in the intersection region in the second position.

* * * * *